US009028233B2

(12) United States Patent
Linde et al.

(10) Patent No.: US 9,028,233 B2
(45) Date of Patent: May 12, 2015

(54) ROTARY PISTON PUMP AND METHOD FOR OPERATING A ROTARY PISTON PUMP

(71) Applicant: NETZSCH-Pumpen & Systeme GmbH, Selb (DE)

(72) Inventors: Hans Juergen Linde, Coburg (DE); Bernhard Murrenhoff, Buchbach (DE); Robert Kurz, Aschheim (DE); Reinhard Denk, Muehldorf (DE); Josef Strassl, Straubing (DE); Thomas Boehme, Waldkraiburg (DE); Hisham Kamal, Waldkraiburg (DE); Stefan Weigl, Muehldorf am Inn (DE); Roger Willis, Mettenheim (DE); Stefan Kern, Haag (DE); Johann Kreidl, Waldkraiburg (DE); Gunter Herr, Haarth (DE); Franz Kneidl, Waldkraiburg (DE); Mikael Tekneyan, Waldkraiburg (DE); Erwin Weber, Ampfing (DE); Marcel Verhoeven, Hailsham East Sussex (GB); Mathias Gradl, Sesslach (DE); Udo Enderle, Marktrewitz (DE)

(73) Assignee: NETZSCH-Pumpen & Systeme GmbH (DE)

( * ) Notice: Subject to any disclaimer, the term of this patent is extended or adjusted under 35 U.S.C. 154(b) by 0 days.

(21) Appl. No.: 13/646,364

(22) Filed: Oct. 5, 2012

(65) Prior Publication Data

US 2013/0094985 A1 Apr. 18, 2013

Related U.S. Application Data

(63) Continuation of application No. PCT/DE2011/000373, filed on Apr. 6, 2011.

(30) Foreign Application Priority Data

Apr. 8, 2010 (DE) ..... 10 2010 014 218

(51) Int. Cl.

| | |
|---|---|
| ***F01C 1/24*** | (2006.01) |
| ***F03C 2/00*** | (2006.01) |
| ***F03C 4/00*** | (2006.01) |
| ***F04C 15/00*** | (2006.01) |
| ***F01C 17/00*** | (2006.01) |
| ***F01C 17/02*** | (2006.01) |
| ***F01C 21/00*** | (2006.01) |
| ***F04C 2/12*** | (2006.01) |

(52) U.S. Cl.

CPC ..... *F04C 15/0061* (2013.01); *F01C 17/00* (2013.01); *F01C 17/02* (2013.01); *F01C 21/008* (2013.01); *F04C 2/126* (2013.01); *F04C 2230/91* (2013.01); *F04C 2240/402* (2013.01)

(58) Field of Classification Search

USPC ..... 418/19, 22–25, 30–31, 199, 205, 1, 4, 418/201.1, 152, 153, 206.1–206.9; 474/101–138; 417/359–363

See application file for complete search history.

(56) References Cited

U.S. PATENT DOCUMENTS 2,745,355 A * 5/1956 Mosbacher ..... 418/4
3,768,324 A * 10/1973 Vanderstegen-Drake .... 474/115

(Continued)

FOREIGN PATENT DOCUMENTS

DE 3825372 A1 2/1990
DE 10334481 A1 * 3/2005
DE 102005062892 B3 6/2007

*Primary Examiner* — Theresa Trieu

(74) *Attorney, Agent, or Firm* — St. Onge Steward Johnston & Reens LLC

(57) ABSTRACT

A rotary piston pump equipped with a motor having two counter-rotating rotary pistons. The two rotary pistons are housed in an oval pump housing. The two rotary pistons are arranged on a first output shaft and a second output shaft. The first output shaft and the second output shaft are driven and synchronized via at least one elastic element.

11 Claims, 10 Drawing Sheets

(56) References Cited

U.S. PATENT DOCUMENTS 4,154,560 A * 5/1979 Streicher ..... 418/4
4,674,960 A * 6/1987 Rando et al. ..... 418/206.8
4,919,598 A * 4/1990 Wycliffe ..... 417/362
4,969,857 A * 11/1990 Kumm ..... 474/49
6,478,560 B1 * 11/2002 Bowman ..... 418/199
7,216,621 B2 * 5/2007 Pigott et al. ..... 123/195 A
7,226,377 B2 * 6/2007 Kraus et al. ..... 474/135
2008/0131302 A1 * 6/2008 Tanigawa ..... 418/205

* cited by examiner

ROTARY PISTON PUMP AND METHOD FOR OPERATING A ROTARY PISTON PUMP

FIELD OF THE INVENTION

The present invention relates to a rotary piston pump and a method for operating a rotary piston pump.

BACKGROUND OF THE INVENTION

A rotary piston pump is equipped with at least one motor, which drives at least two counter-rotating rotary pistons. The rotary pistons move in a pump housing. The at least two rotary pistons are disposed on a first output shaft and a second output shaft. The two output shafts are synchronised and driven in such a way that the at least two rotary pistons are in an active interrelation with one another and form an action pair.

German patent application DE 38 25 372 A1 describes a driving engine with two ring cylinders disposed in a plane, in which rotary pistons are disposed. The rotary pistons are fixed on the periphery of a rotor disc sitting in each case in a rotationally fixed manner on a shaft. The rotor discs comprise at the periphery a corresponding slot into which the respective ring cylinders penetrate, wherein the two rotary pistons engage into one another. The task of the driving engine is to cause the rotary pistons to rotate by combustion of a suitable substance and via the latter to drive the shafts. Depending on the design of the gearing, the rotary pistons can rotate both in the same and in the opposite direction.

Disclosed in German patent specification DE 10 2005 062 892 B2 is a rotary piston engine, which is used as an internal combustion engine or as a driven machine. The two rotary pistons disposed diametrically opposite periodically give rise to volume-variable working chambers in a ring cylinder housing. The rotary pistons are connected to one another in a rotationally rigid manner by means of shafts inserted into one another, so that the shafts act on a common output shaft individually via, in each case, a flexible drive system with elliptical transmission discs. The flexible drive can be constituted with a toothed belt, a toothed chain or a chain. By means of two elliptical control toothed pinions in the system, said control toothed pinions being disposed symmetrically, constant pre-tensioning forces are achieved in the strand and at the same time a mutual transfer of the torque with a change in the direction of rotation.

Both the publications cited above deal with driving engines, which are constituted such that an output shaft is moved by means of rotary pistons and a corresponding device. Despite the use of similar components, the machines are not comparable with the rotary piston pumps of the present invention.

SUMMARY OF THE INVENTION

One problem underlying the invention is to provide a compact, low-maintenance and economical rotary piston pump.

The above problem is solved by a rotary piston pump with at least one motor with at least two counter-rotating rotary pistons and a pump housing.

Furthermore, a problem underlying the invention is to create a method, with which a rotary piston pump can be operated disruption-free and economically.

This problem is solved by a method for the operation of a rotary piston pump.

Further embodiments according to the invention can be derived from the present teachings.

The rotary piston pump according to the invention may be provided with at least one motor and with at least two counter-rotating rotary pistons. The at least two rotary pistons are disposed in a pump housing. Furthermore, the at least two rotary pistons are disposed on a first output shaft and a second output shaft. The first output shaft and the second output shaft are synchronised with one another and driven in such a way that the at least two rotary pistons engage into one another. This is achieved by the fact that the output shafts can be driven and synchronised by means of an elastic element. Engaging into one another is to be understood to mean that the rotary pistons form with one another an action pair in an active interrelation.

One embodiment of the rotary piston pump with an elastic element has considerable advantages over the prior art. In the first place, there is a safeguarding of the rotary pistons against clogging up due to jamming of solids in the rotary piston pump and in the second place the rotary piston pump can be operated oil-free.

This high mobility of solids results from the fact that the elastic element is able to yield in the presence of clogging up in the region of the rotary pistons. Through the use of the elastic element, it is possible to dispense with conventional gearing which has to run in oil. Furthermore, the power density of the rotary piston pump is increased and at the same time the weight reduced through the simultaneous driving and synchronising of the rotary pistons.

In a preferred embodiment, the elastic element is an endless, flexible element. This endless, flexible element can be a double-toothed belt, a chain or a link belt. The lubrication of the drive system can be completely dispensed with when use is made of a double-toothed belt, which is advantageous especially when use is made of the rotary piston pump in the area of the pharmaceuticals and/or foodstuffs industry. Lubrication has to be employed in the case where use is made of chains or link belts. The outlay for the lubrication of the chains and link belts is much less than is the case with conventional rotary piston pumps driven by means of gearing.

The double-toothed belt can have different profiles. It is important here that the double-toothed belt exhibits a certain flexibility. As a result of this flexibility, it is possible in the case of a blockage to compensate briefly for the instantaneously occurring synchronous rotation of the rotary pistons by means of an expansion of the double-toothed belt. The teeth of the double-toothed belt are always constituted in such a way that they form optimum action pairs with the teeth of the toothed wheels present in the system and thus transmit the forces in the optimum manner from the drive shaft to the rotary pistons. Furthermore, the teeth of the double-toothed belt should be constituted in such a way that, in the event of the complete blockage of the rotary pistons, they represent the weakest link in the active system. As a result, for example, the teeth at the point of maximum load would be torn off.

The endless, flexible element can have a free strand length between a first output wheel and a second output wheel. This free strand length represents a buffer region. The mobility of solids in the rotary piston pump is guaranteed by the free strand length. The greater the free strand length, the more intensively the rotary pistons can twist against one another. This twisting of the rotary pistons with respect to one another is ended after at most one complete revolution of the rotary pistons. Due to the fact that the twisting is removed again after at most one complete revolution, the proper function of the rotary piston pump is guaranteed. It follows from this that the length of the free strand is directly dependent on the size of the solid parts in the medium to be conveyed. The larger the solid bodies in the medium, the larger the free strand length must be. This is of course possible only up to a specific size of solid. The mobility of solids in the rotary piston pump, furthermore, is dependent on the rotary pistons and their surface quality.

According to an example embodiment, the length of the free strand can be adjusted by means of the radii of the first output wheel and the second output wheel. The larger the radii, the smaller the free strand length. The radii of the two output wheels must always be of identical size, because otherwise there is no synchronicity of the rotary pistons. Furthermore, it is possible to adjust the length of the free strand by the spacing between the first output shaft and the second output shaft. The spacing of the output shafts is dependent on the constitution of the rotary pistons. The larger the rotary pistons, the greater the spacing between the output shafts. If the spacing between the output shafts is great, the active system can also comprise a large free strand length and thus a high mobility of solids. The free strand length also influences the synchronisation precision. The shorter the length of the free strand, the more precisely the rotary piston pump can be synchronised. This also applies to the possible length extension of the free strand.

In a further preferred embodiment, the elasticity is provided by plastic-coated toothed wheels. The plastic coating is constituted such that it allows the rotary pistons to have an offset of the angle of rotation. It is the case here that the larger the offset of the angle of rotation of the rotary pistons with respect to one another, the higher the mobility of solids in the rotary piston pump.

Through the use of an elastic element for driving the rotary piston pump, it is possible to position the motor above and/or to the side of the pump housing. Due to the fact that a fixed gearing is dispensed with, the position of the motor with respect to the rotary piston pump can be adapted to the requirements of the place of installation.

In a preferred embodiment, the motor is provided above the actual pump housing. This combination of motor and pump is generally referred to as "piggyback". This embodiment brings the advantage that the centre of gravity of the motor and of the rotary piston pump lies in an axis. Furthermore, it is possible by means of the "piggyback" to integrate the rotary piston pump directly and with a short structural shape into the pipeline system.

In the case of large rotary piston pumps, it is possible by means of the elastic element to drive the rotary piston pump by means of a plurality of motors. Thus, it is possible for example to select two smaller motors in order to better distribute the weight of the overall active system. For example, motors which run exactly synchronously are used to drive the rotary piston pump.

In order to safeguard the operation of the rotary piston pump, a system for maintaining the element tensioning is assigned to the endless, flexible element. At least one secondary machine can be driven with the device for maintaining the element tensioning. A secondary machine can for example be another pump or a preliminary size reducer. A secondary pump can be used for example for the addition of lubricant or for the addition of liquefying agents to the medium to be pumped. Furthermore, it is also possible to use the secondary pump as a rinsing pump for the sliding ring seal.

Devices for the tensioning of toothed belts and/or chains are known from the prior art. It is also known that there is a large number of secondary devices that can be assigned to a rotary piston pump. The information previously provided does not therefore represent a conclusive limitation of the scope of protection.

According to a method according to the invention for operating a rotary piston pump, the first output shaft and the second output shaft are driven and synchronised by at least one motor via an elastic element. An endless, flexible element or at least one elastically coated toothed wheel can be used for the elastic element.

In a further embodiment, the rotary piston pump is driven by at least two motors. The endless, flexible element is held under tension by a device. Furthermore, at least one secondary machine can be driven with this device.

Examples of embodiment are intended to explain the invention and its advantages in greater detail below with the aid of the appended figures. The size ratios of the individual elements with respect to one another in the figures do not always correspond to the actual size ratios, since some forms are represented simplified and other forms enlarged in relation to other elements for the sake of better clarity.

DETAILED DESCRIPTION OF THE INVENTION

Identical reference numbers are used for identical or identically acting elements of the invention. Furthermore, for the sake of clarity, only reference numbers that are required for the description of the given figure are represented in the individual figures.

Figure 1:
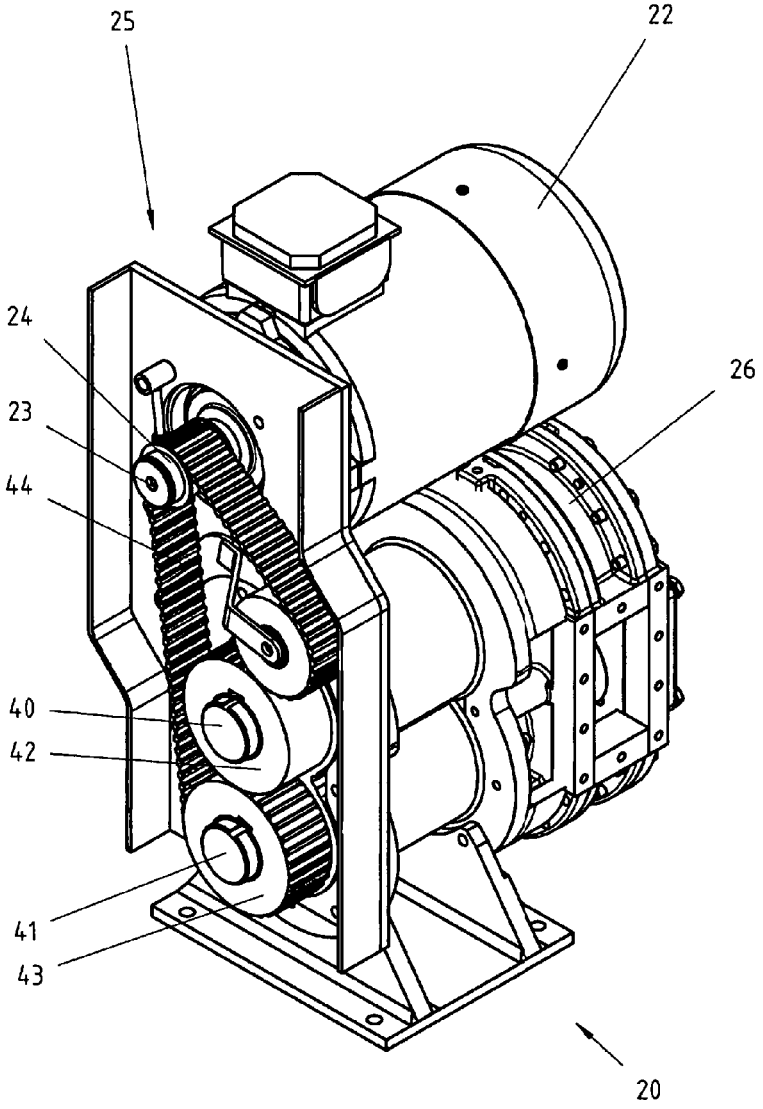
FIG. 1 shows diagrammatically the structure of a rotary piston pump with a drive and synchronisation device according to the invention.

FIG. 1 shows diagrammatically the structure of a rotary piston pump 20 with a drive and synchronisation device 25 according to the invention. In the case of rotary piston pump 20 according to the invention, a motor 22 is disposed above pump housing 26. Motor 22 is connected to a drive shaft 23, which moves a drive wheel 24. An elastic element 44 is driven in a rotational manner via drive wheel 24. A first output wheel 42 and a second output wheel 43 are driven by means of elastic element 44. First output wheel 42 is connected in a form-fit and/or friction-locked manner to a first output shaft 40 and a second output wheel 43 to a second output shaft 41. The rotary pistons are driven via first output shaft 40 and via second output shaft 41 (see FIG. 2).

Figure 2:
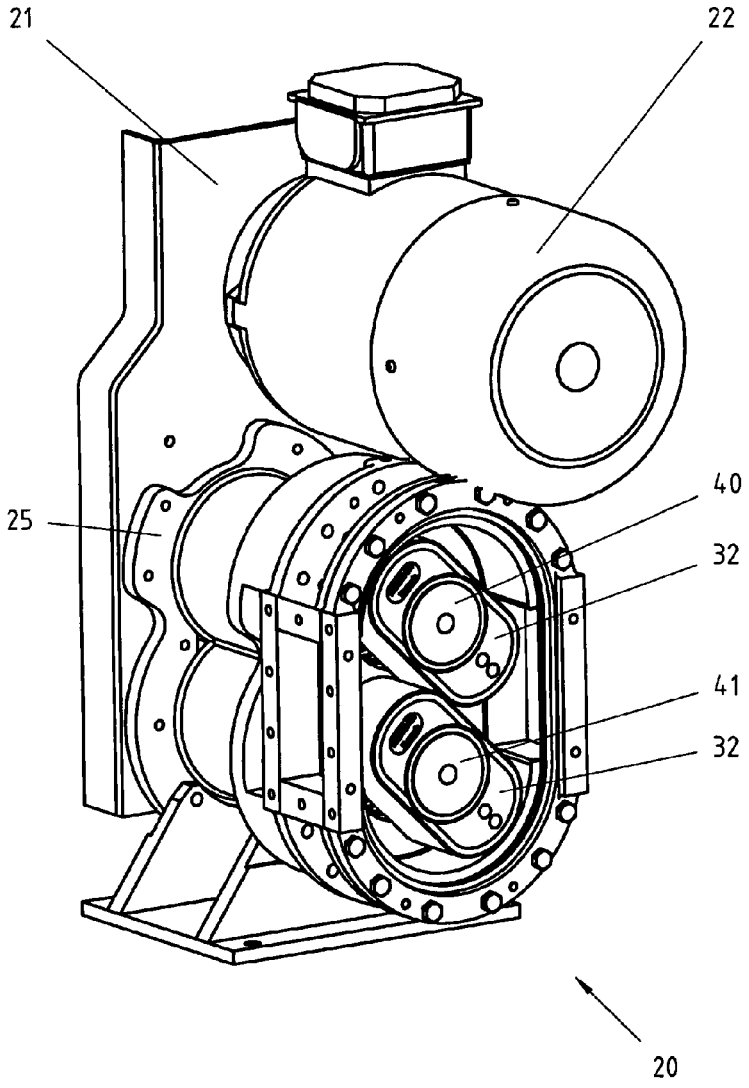
FIG. 2 shows diagrammatically a rotary piston pump with opened pump housing.

FIG. 2 represents diagrammatically a rotary piston pump 20 with opened pump housing 26. Motor 22 is fitted above pump housing 26. Only one assembly plate 21 of drive and synchronising device 25 can be seen in FIG. 2. Rotary pistons 32 are located in pump housing 26. One rotary piston 32 is driven by first output shaft 40 and second rotary piston 32 by a second output shaft 41.

Figure 3:
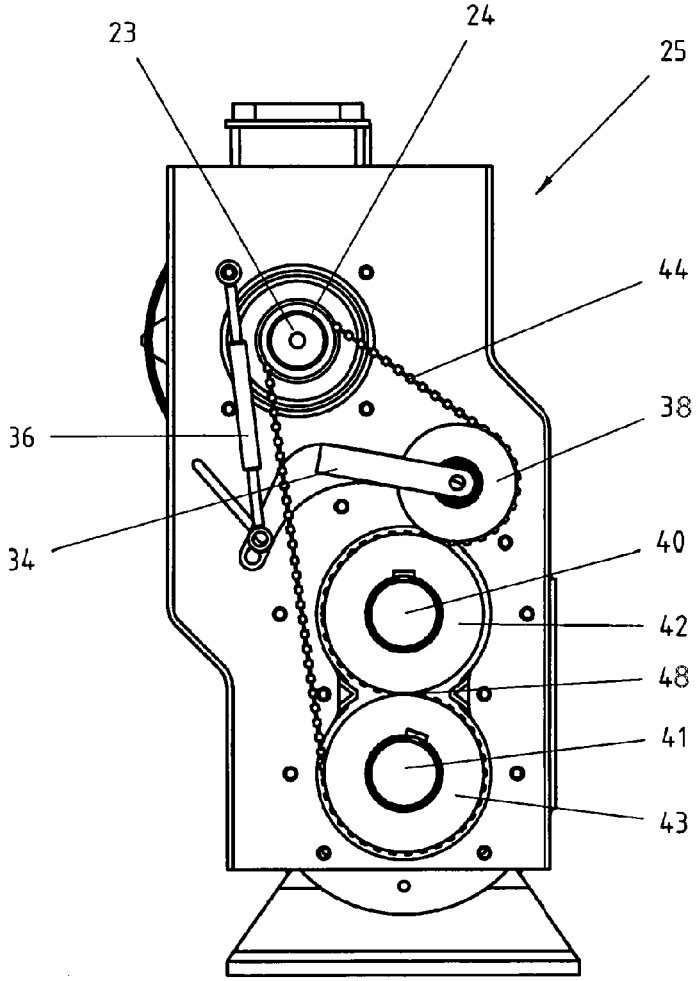
FIG. 3 shows the diagrammatic structure of a drive and synchronisation device with a separate tensioning device.

FIG. 3 shows the diagrammatic structure of a drive and synchronisation device 25 with a separate tensioning device 34. Drive wheel 24, which transmits the rotational forces of drive shaft 23 to elastic element 44, is driven by drive shaft 23. Elastic element 44, a double-toothed belt, drives first output wheel 42 and second output wheel 43, wherein first output wheel 42 causes first output shaft 40 to rotate and second output wheel 43 causes second output shaft 41 to rotate. In order that elastic element 44 always has the correct tensioning, it is held under tension by means of tensioning device 34. The intensity of the pretensioning can be adjusted by means of a tensioning element 36. Since first output shaft 40 and second output shaft 41 have to rotate in opposite directions, first output wheel 42 is driven by the outer side of elastic element 44 and second output wheel 43 by the inner side of elastic element 44. This change of engagement takes place in region 48 between drive wheels 42 and 43.

Figure 4:
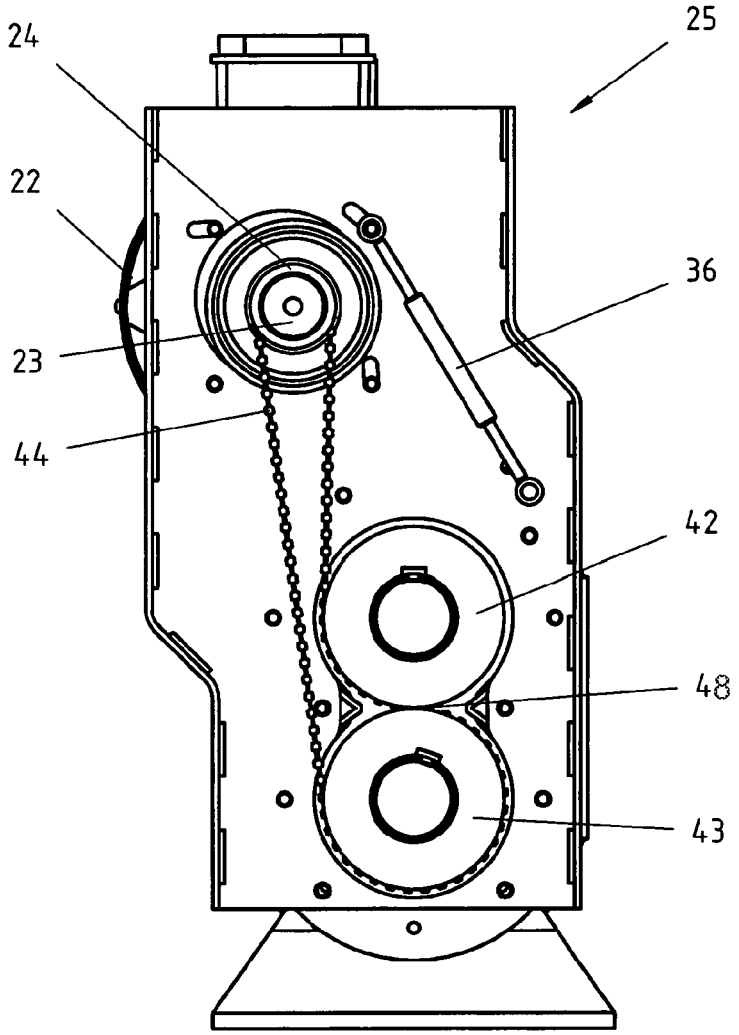
FIG. 4 shows diagrammatically how the drive and synchronisation device can be tensioned without a separate tensioning device.

FIG. 4 represents diagrammatically a drive and synchronisation device 25 without a separate tensioning device. In this embodiment, elastic element 44 is led directly from drive wheel 24 to first output wheel 42. From there, it is transferred via a region 48 to second output wheel 43. In order to maintain the required tensioning on elastic element 44, motor 22 is moved with drive shaft 23 and drive wheel 24 in this example of embodiment. With tensioning element 36, motor 22 is moved away from drive wheels 42 and 43 until such time as the required pretensioning of elastic element 44 is present.

Figure 5A:
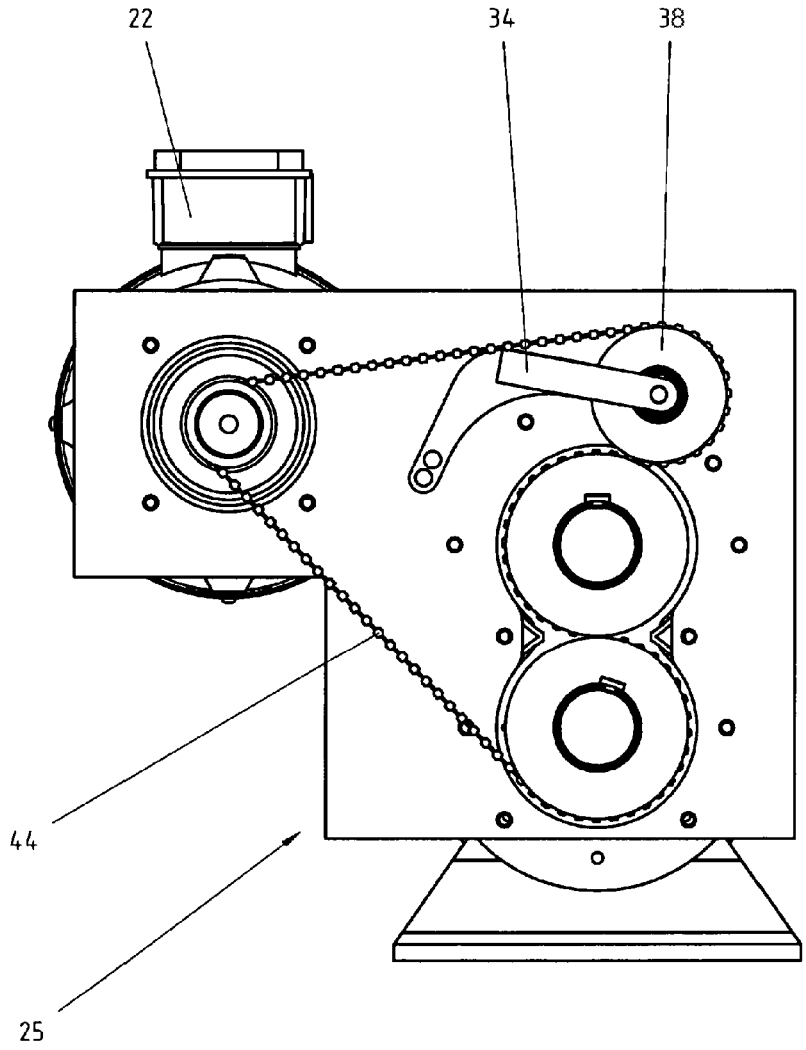
FIGS. 5*a* to 5*c* show different examples of embodiments for the arrangement of the motor with respect to the rotary piston pump.
Figure 5B:
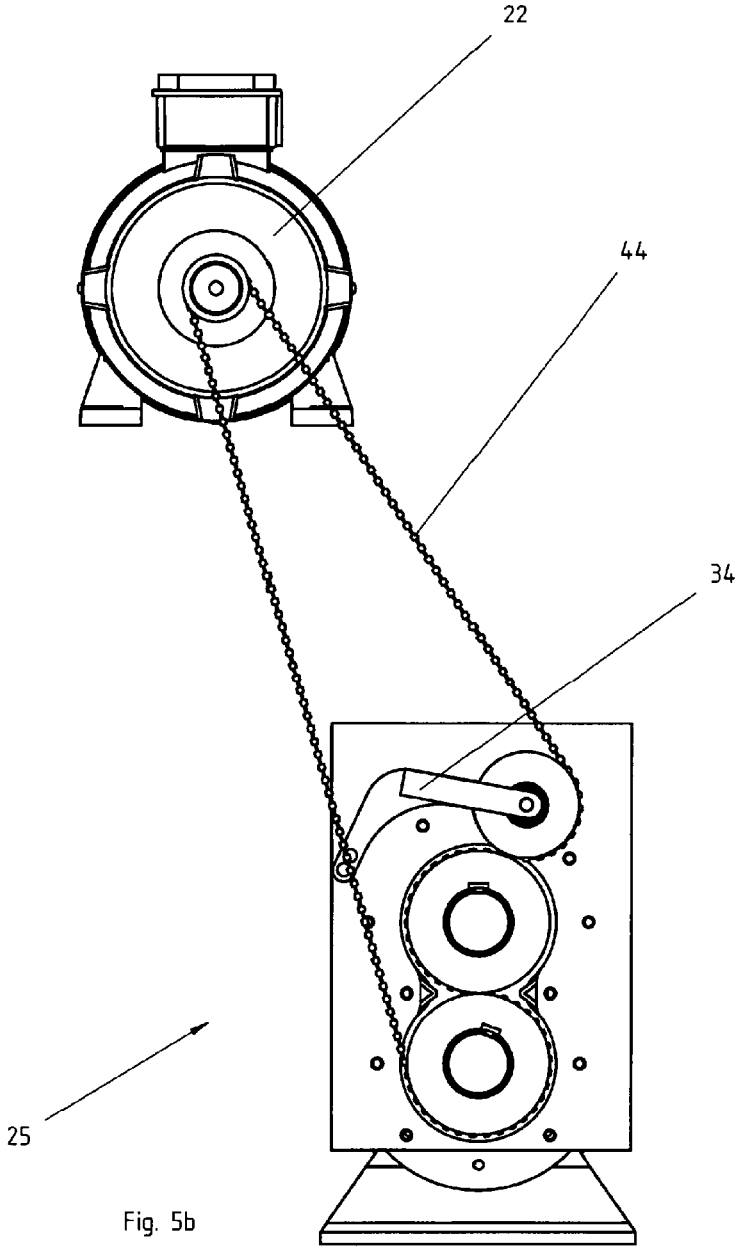
Figure 5C:
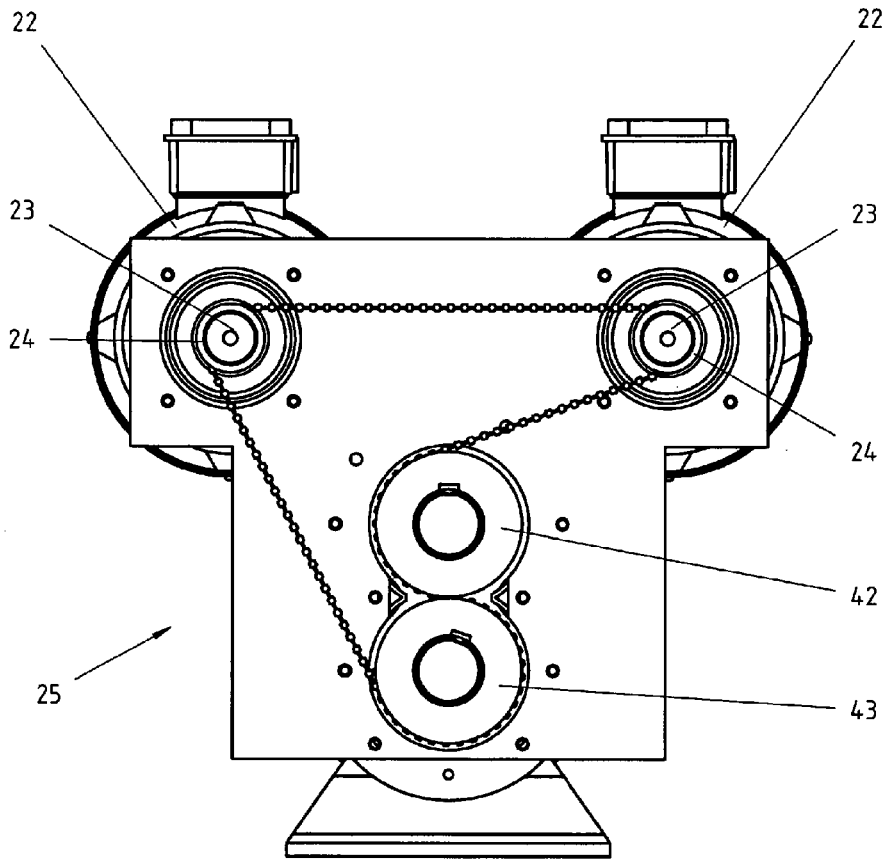

FIGS. 5*a* to 5*c* show different examples of embodiment of the arrangement of motor 22 with respect to rotary piston pump 20.

FIG. 5*a* represents diagrammatically a motor 22 offset laterally with respect to drive and synchronisation device 25. In this embodiment, a tensioning roll 38 is present, which holds elastic element 44 under pretensioning. Due to the fact that motor 22 is fitted offset laterally, the length of elastic element 44 is increased, as a result of which the use of a tensioning device 34 is essential.

FIG. 5*b* represents a drive and synchronisation device 25 for a rotary piston pump, wherein motor 22 is not disposed in the spatial vicinity of drive and synchronisation device 25. In this example of embodiment, it is intended to be shown that it is possible, using an elastic element 44, to install motor 22 farther removed from the rotary piston pump. Here too, a tensioning device 34 is required in order to keep elastic element 44 under tension.

FIG. 5*c* shows diagrammatically how a rotary piston pump (not represented here) driven by two motors 22 can be constituted. In this example embodiment, two motors 22 are disposed above drive and synchronisation device 25. Each of the two motors 22 comprises a separate drive shaft 23 and a drive wheel 24 assigned to drive shaft 23. Elastic element 44 runs via two drive wheels 24 and is led from there around first output wheel 42 and around second output wheel 43. The pretensioning for elastic element 44 is produced by the fact that one of motors 22 is connected in a mobile manner to drive and synchronisation device 25. Mobile motor 22 is displaced until elastic element 44 has the required tensioning.

Figure 6A:
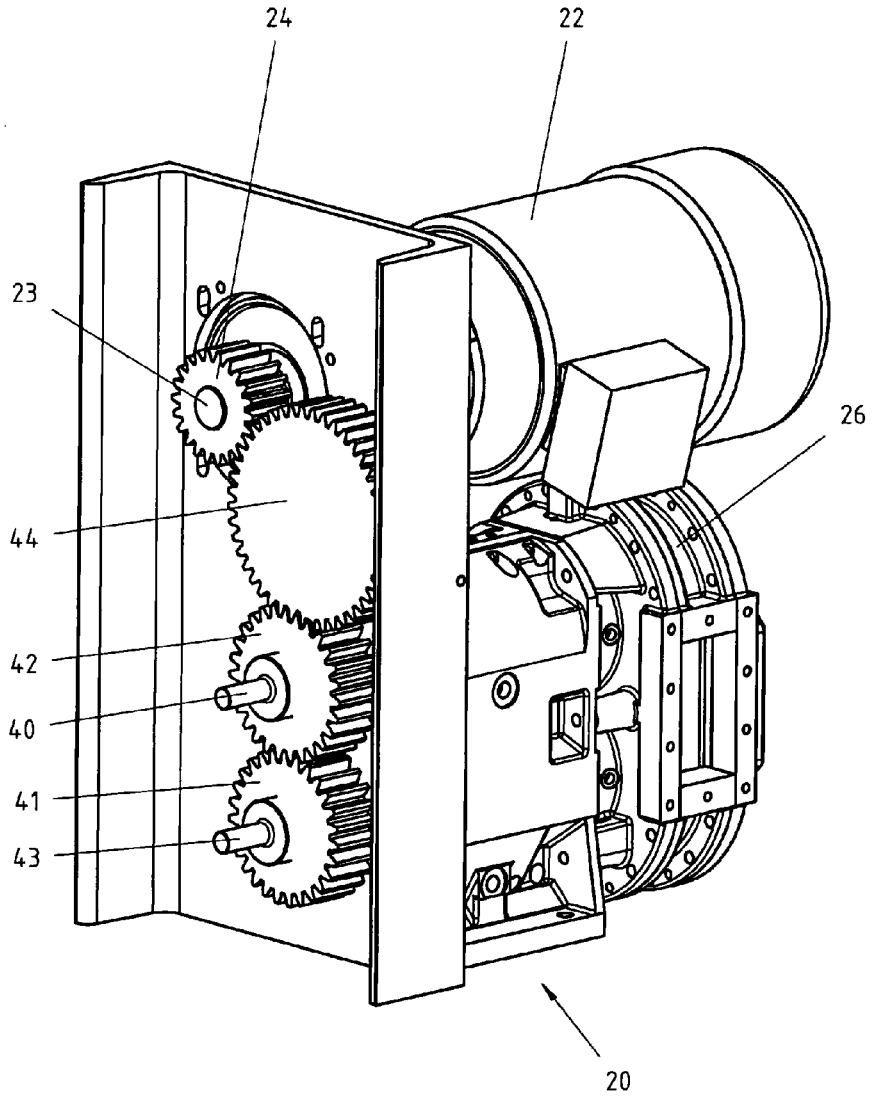
FIG. 6*a* shows diagrammatically the structure of a rotary piston pump, wherein the elastic element is a toothed wheel coated with plastic.

FIG. 6*a* shows diagrammatically the structure of a rotary piston pump 20, wherein elastic element 44 is a toothed wheel coated with plastic. As in the examples of embodiments in FIGS. 1 and 2, motor 22 is disposed above pump housing 26. In this example embodiment, drive wheel 24, which is disposed on drive shaft 23, engages directly into elastic element 44 constituted as a toothed wheel. This toothed wheel in turn engages into first output wheel 42. First output wheel 42 is in a direct active relationship with second output wheel 43. Output wheels 42 and 43 drive first output shaft 40 and second output shaft 41, which in turn drive the rotary pistons (not represented here) of rotary piston pump 20. In order to be able to obtain the best possible mobility of solids, first and/or second drive wheel 42, 43 can likewise be coated elastically.

Figure 6B:
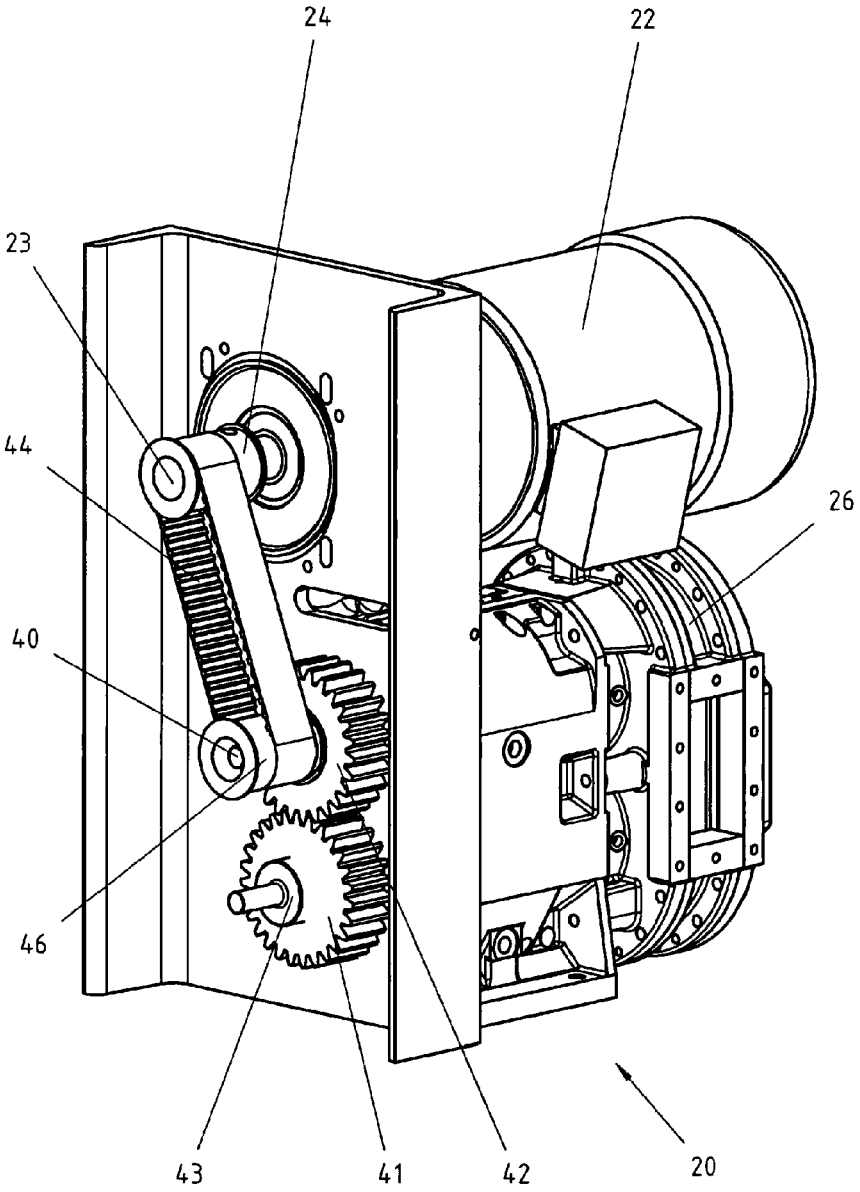
FIG. 6*b* shows diagrammatically the structure of a rotary piston pump, wherein the elastic element is a toothed belt, which drives a toothed wheel on the first output shaft.

FIG. 6*b* shows diagrammatically the structure of a rotary piston pump 20, wherein elastic element 44 is a toothed belt, which drives a toothed wheel 46 on first output shaft 40. Elastic element 44 is moved in a rotary manner by motor 22 via drive wheel 24. This motion is transmitted from elastic element 44 to toothed wheel 46, which is disposed on first output shaft 40. First output wheel 42 and the first rotary piston, which is located in pump housing 26, are driven by means of first output shaft 40. The motion is transmitted from first output wheel 42 to second output wheel 43. Second output wheel 43 is linked on second output shaft 41. The second rotary piston, which is located in pump housing 26, is driven by means of second output shaft 41.

Figure 7:
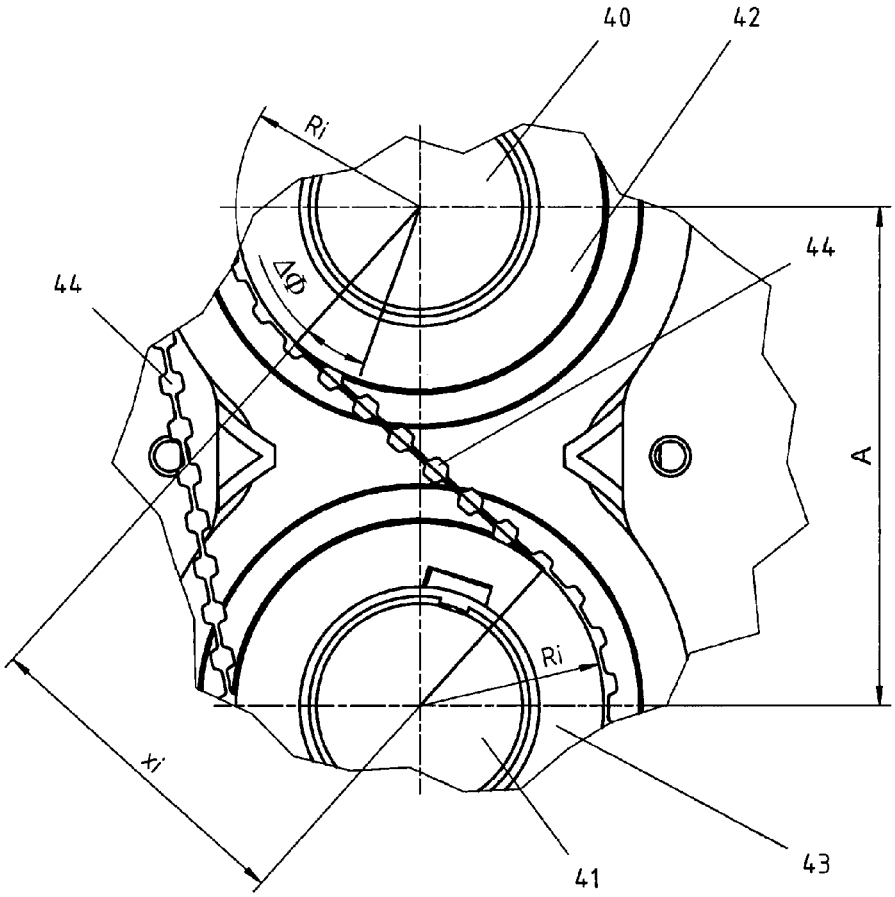
FIG. 7 shows diagrammatically the course of the endless, flexible element with a free strand length between the output wheels.

FIG. 7 represents diagrammatically the course of endless, flexible element 44, with free strand length Xi, between output wheels 42 and 43. Free strand length Xi is determined by the constitution of active radii Ri of output wheels 42 and 43. The larger the active radii Ri of output wheels 42 and 43, the smaller the free strand length Xi. Another possibility for varying the length of free strand Xi consists in changing a spacing A between first output shaft 40 and second output shaft 41. In the embodiment described in FIG. 7, a relatively large free strand length Xi is represented on account of small active radii Ri of output wheels 42 and 43. A relatively great twisting capability $\Delta\theta$ of the output wheels thus results.

The invention has been described by reference to a preferred embodiment. A person skilled in the art can however imagine that modifications or changes to the invention can be made without thereby departing from the scope of protection of the following claims.

What is claimed is:

1. A rotary piston pump comprising:

at least one motor and at least two counter-rotating rotary pistons, the at least two rotary pistons are disposed on a first output shaft and a second output shaft, the first output shaft and the second output shaft are synchronised and driven in such a way that the at least two rotary pistons engage into one another, at least one elastic element connecting the at least two rotary pistons to one another at a drive side of the pump and to the at least one motor, at least one tensioning element adjusting an intensity of tension in the at least one elastic element, a device maintaining tension in the at least one elastic element, and a pump housing containing the at least two rotary pistons;

wherein the elastic element has teeth engaged with a first output wheel of the first output shaft and a second output wheel of the second output shaft, the teeth being a weak link in the pump such that they are adapted to break down during complete blockage of the rotary pistons.

2. The rotary piston pump according to claim 1, characterised in that the elastic element is an endless, flexible element.

3. The rotary piston pump according to claim 2, characterised in that the endless, flexible element comprises at least one of a double-toothed belt, a chain, or a link belt.

4. The rotary piston pump according to claim 3, characterised in that the endless, flexible element has a free strand between the first output wheel and the second output wheel, the free strand having a length determined by an active radii of the first output wheel and the second output wheel and/or that the degree of the synchronisation precision is determined by means of the length of the free strand between the first output wheel and the second output wheel.

5. The rotary piston pump according to claim 4, characterised in that the length of the free strand is determined by means of a spacing between the first output shaft and the second output shaft.

6. The rotary piston pump according to claim 1, characterised in that the motor is positioned above and/or at the side of the pump housing.

7. The rotary piston pump according to claim 1, characterised in that the rotary piston pump is driven by a plurality of motors.

8. A method for the operation of a rotary piston pump, the method comprising:

providing at least one motor and at least two counter-rotating rotary pistons, the at least two rotary pistons being disposed on a first output shaft and a second output shaft, the first output shaft and the second output shaft being synchronised and driven in such a way that the at least two rotary pistons engage into one another housing the at least two rotary pistons in a pump housing, connecting the at least two rotary pistons to one another at a drive side of the pump via at least one elastic element, the elastic element has teeth engaged with a first output wheel of the first output shaft and a second output wheel of the second output shaft, the teeth being a weak link in the pump such that they are adapted to break down during complete blockage of the rotary pistons;

adjusting an intensity of tension in the at least one elastic element via at least one tensioning element, holding the at least one elastic element under tension at the intensity defined by the at least one tensioning element by a device for maintaining tension, driving and synchronising the first output shaft and the second output shaft by means of the at least one motor via the at least one elastic element.

9. The method according to claim 8, characterised in that an endless, flexible element is used as the elastic element.

10. The method according to claim 8, characterised in that the rotary piston pump is driven by at least two motors.

11. The rotary piston pump of claim 1, wherein the elastic element has a free strand between the first output wheel and the second output wheel, the free strand having a length configured to end twisting of the rotary pistons with respect to one another after at most one revolution of the rotary pistons.

* * * * *